US010282951B1

(12) United States Patent
Kulick

(10) Patent No.: US 10,282,951 B1
(45) Date of Patent: May 7, 2019

(54) ELECTRICAL CONTINUITY UNATTENDED PACKAGE SECURITY APPARATUS AND METHOD OF OPERATION

(71) Applicant: Thomas A. Kulick, Bremerton, WA (US)

(72) Inventor: Thomas A. Kulick, Bremerton, WA (US)

( * ) Notice: Subject to any disclaimer, the term of this patent is extended or adjusted under 35 U.S.C. 154(b) by 0 days.

(21) Appl. No.: 16/008,158

(22) Filed: Jun. 14, 2018

(51) Int. Cl.
*G08B 13/12* (2006.01)

(52) U.S. Cl.
CPC ..... *G08B 13/12* (2013.01)

(58) Field of Classification Search
CPC ..... G08B 13/00; G08B 13/06; G08B 13/12; G08B 13/14; G08B 13/126; G08B 13/128; G08B 1/08; G08B 21/00
USPC ..... 340/568.1, 568.2, 568.3, 571, 825.49, 340/539.22; 70/58; 235/383, 385; 324/541
See application file for complete search history.

(56) References Cited

U.S. PATENT DOCUMENTS 4,686,912 A * 8/1987 Fogleman ..... E05B 47/0603 109/59 T
5,561,417 A * 10/1996 Rothbaum ..... G08B 13/1454 340/568.2
5,624,071 A 4/1997 Sosan
5,831,531 A 11/1998 Tuttle
6,612,489 B2 9/2003 McCormick
6,690,277 B1 * 2/2004 Hansen ..... G08B 13/1454 340/568.2
6,690,997 B2 2/2004 Rivalto
7,088,257 B2 8/2006 Weekes
9,364,112 B2 6/2016 Sundaresan
2005/0275531 A1 * 12/2005 Johnson ..... G06K 7/0008 340/539.22
2008/0072633 A1 * 3/2008 Samuel ..... E05B 67/003 70/58
2008/0121682 A1 5/2008 Grim
2009/0101711 A1 4/2009 Grayson
2013/0077896 A1 3/2013 Wiley
2014/0000322 A1 1/2014 Williams
2014/0008246 A1 1/2014 Pfeiffer
2017/0091710 A1 3/2017 Van Dyke

* cited by examiner

*Primary Examiner* — Hung T Nguyen
(74) *Attorney, Agent, or Firm* — Vincent G. LoTempio; Kloss, Stenger & LoTempio; David T. Stephenson

(57) ABSTRACT

An electrical continuity unattended package security apparatus and method of operation prevents unattended delivered packages from theft or molestation. A bag contains an item. The bag has a mesh sidewall weaved with a matrix of conductive wires. An electric cable, carrying electrical current is in contact with conductive wires. A current sensing device detects a disturbance to electrical continuity through the electric cable and conductive wires, such as attempts to cut the cable or open the bag. A disturbance to the electric cable or conductive wires triggers a visual and audible alarm. The terminus of the cable forms a loop that serves as a mounting means to the anchoring structure. Fasteners also serves as a mounting means. A coded pad controls a gate. When the package recipient or package deliverer register a predetermined code, the gate opens to enable access to electric cable and alarm reset means.

20 Claims, 9 Drawing Sheets

ELECTRICAL CONTINUITY UNATTENDED PACKAGE SECURITY APPARATUS AND METHOD OF OPERATION

FIELD OF THE INVENTION

The present invention relates generally to an electrical continuity unattended package security apparatus and method of operation. More so, the present invention relates to a package security apparatus that prevents an unattended item from being stolen or molested by detecting disturbance to electrical continuity through an electric cable and a bag defined by a matrix of conductive wires; whereby a disturbance to the electric cable or the conductive wires triggers a visual and/or audible alarm to indicate the disturbance; whereby the terminus of the cable forms a loop that serves as a mounting means to an anchoring structure; and whereby a coded pad controls a gate, such that when the package recipient or package deliverer register a predetermined code, the gate opens to enable access to electric cable and alarm reset means.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, a package for delivery is left at or near a recipient's door if the recipient does not grant access to a carrier employee delivering the package. For example, a carrier employee attempting to deliver a box to a user's home may ring the user's doorbell. The user may not be home or may not hear the doorbell and, thus, the carrier employee may leave the box outside the user's door. A package left at or near a recipient's door may be susceptible to damage via environmental conditions (e.g., rain, snow, ice, wind, etc.), traffic (e.g., foot traffic, pets, etc.), and may also be susceptible to theft.

Generally, known package pick-up and delivery arrangements used to distribute goods or packages fundamentally operate on human interaction. For example, goods are typically collected by a courier at a drop box or scheduled on-site pick-up. Information identifying the packages and their destination is typically entered into a centralized tracking database by the courier or other personnel. The packages are then transported to a distribution node for sorting, routing, and hand delivery to the intended destination. Delivery of the packages again requires a courier to physically carry the package to the intended destination. If a package can not be delivered to the destination, for example a home residence where none of the occupants are home at the time of delivery, the package must be couriered to a retention facility for later pick-up by the intended party or another delivery attempt must be scheduled.

There is currently a great need for an improved delivery system in a situation where a person is not available to receive the item at the time of the delivery. The great increase in the number of households where both husband and wife work out of the home, and the growing volume of E-commerce combine to increase this need. It is very costly for delivery companies to make return calls, and simply leaving packages on a porch or doorway invites theft and precludes verification of delivery.

Ideally an addressee who expects to receive a package, or who receives notice of a package delivery attempt would temporarily deploy a large receptacle on his apartment door which would be accessible to both the U.S. mail carrier and private carriers such as United Parcel Service, or Federal Express but not to anyone else. The receptacle would be removably attached to the apartment door so that it can only be removed when the apartment door is first unlocked and opened. The size of the container would permit it to accommodate the majority of packages that are sent through the mail and it would be strong enough to resist the kind of minor tampering that may occasionally occur in an apartment building.

U.S. Pat. No. 3,934,434 to Law discloses a key safe with a combination lock which can be attached to a door. The key safe is designed to separate when unlocked, into an upper attachment means and a main lower body. By its design, operation and small size it is not suitable for use as a package receptacle. Similarly, U.S. Pat. No. 4,703,850 to Walker discloses a receptacle for the temporary storage of shoes in a hotel. The receptacle is opened by key, attaches to the top of the door, which substantially forms a portion of the backwall of the receptacle. By its design, limited size, and method of use, the receptacle is unsuited for receiving large packages and is not available to mail carriers. U.S. Pat. No. 1,351,388 to Kabaci discloses a locking device for closing the mouth of a mailbag. The lock utilizes a loop which threads into eyelets in the sack and can be used as a handle for carrying the sack. A key operated lock is attached to the loop and can be locked to prevent opening of the sack.

Other proposals have involved package securing devices that protect unattended delivered packages. The problem with these locking devices is that they do not trigger a visual and/or audible alarm to indicate the disturbance to the package. Also, they do not have a coded pad that controls a gate, such that when the package recipient or package deliverer register a predetermined code, the gate opens to enable access to electric cable and alarm reset means. Even though the above cited package securing devices meets some of the needs of the market, an electrical continuity unattended package security apparatus that prevents an unattended item from being stolen or molested by detecting disturbance to electrical continuity through an electric cable and a bag defined by a matrix of conductive wires; whereby a disturbance to the electric cable or the conductive wires triggers a visual and/or audible alarm to indicate the disturbance; whereby the terminus of the cable forms a loop that serves as a mounting means to an anchoring structure; and whereby a coded pad controls a gate, such that when the package recipient or package deliverer register a predetermined code, the gate opens to enable access to electric cable and alarm reset means, is still desired.

SUMMARY

Illustrative embodiments of the disclosure are generally directed to an electrical continuity unattended package security apparatus and method of operation. The package security apparatus serves to help prevent an unattended item from being stolen or molested by unauthorized people. The apparatus is configured to detect disturbances to the electrical continuity through an electric cable and a bag that is defined by a matrix of conductive wires. A disturbance to the electric cable or the conductive wires triggers a visual and/or audible alarm to indicate the disturbance. The terminus of the electric cable forms a loop that serves as a mounting means to an anchoring structure. A coded pad controls a gate, such that when a predetermined code is entered, the gate is released to an open position to enable access to the cable, alarm reset means, and other components of the apparatus.

In one non-limiting embodiment, the unattended package security apparatus comprises a bag that is configured to receive a delivered item. The bag is defined by a mesh sidewall forming an opening that leads to a cavity for containing the item. A matrix of conductive wires weaves through the mesh sidewall. An electrical current runs through the conductive wires, creating electrical continuity through the mesh sidewalls.

An electric cable is disposed around the periphery of the opening remaining in contact, and thereby electrical continuity with the conductive wires. The electric cable provides a dual function. Firstly, the electric cable can be pulled to cinch the opening of the bag closed. Secondly, since the electric cable is in contact with at least one of the conductive wires, the electric cable carries electrical current to the conductive wires. This connection forms electrically continuity between the electric cable and the conductive wires.

The electric cable extends from the bag and through an alarm portion that attaches near the opening of the bag. The alarm portion comprises a current sensing device that detects if continuity to the electrical current in the cable is disturbed. Thus, if electrical continuity at or near the bag is disturbed, i.e, manipulation of the electric cable, forced entry of the opening, cutting the electric cable or conductive wires, then the electrical continuity is interrupted through the conductive wires and cable. The current sensing device transmits an interruption signal, which triggers an alarm portion to emit a visible and/or audible signal.

The alarm portion comprises an alarm sidewall forming an alarm cavity. An alarm gate may be opened and closed to regulate access to the alarm cavity. An alarm coded pad controls an alarm gate, such that when a predetermined code is entered, the alarm gate is released to an open position; thereby allowing access to the electric cable, alarms, and alarm reset means in the alarm cavity.

A pair of first cable passageways on opposite sides of the alarm sidewall enable passage of the electric cable through the alarm cavity. A releasable cable locking mechanism inside the alarm cavity provides a spring-loaded clamp that clamps down on the electric cable inside the alarm cavity to restrict axial movement. The releasable cable locking mechanism works to securely retain the electric cable inside the alarm cavity. A cable release mechanism regulates the spring-loaded clamp to release the cable therefrom.

The current sensing device, power source, circuit board, illumination alarm, and audible alarm work together to detect disturbance of electrical continuity, which then triggers the visual and audible alarms. The alarm portion also has a power switch inside of it for manually powering off the alarms. If the alarm portion is tampered with, the electrical continuity of the cable is disturbed, which triggers the illumination alarm and/or audible alarm to emit a visible and/or audible signal.

Further, when the package recipient or package deliverer register predetermined alphanumeric digits in the alarm coded pad, the alarm gate is released to an open position. The open position enables access to the cable, current sensing device, releasable cable locking mechanism, cable release mechanism, power switch, power source, circuit board, illumination alarm, and audible alarm.

The electric cable extends from the alarm portion to a mount portion. The mount portion is configured to enable mounting of the apparatus to an anchoring structure, such as a door or post. The mount portion forms the terminus of the apparatus. The mount portion comprises a mount sidewall defined by a mount cavity. A mount gate can be opened and closed to regulate access to the mount cavity. A mount coded pad controls the mount gate. When the package recipient or package deliverer registers a predetermined code in the mount coded pad, the gate opens to enable access to electric cable and alarm reset means.

The mount portion further comprises at least one mount hole, and a pair of second cable passageways that enable passage of the cable in and out of the mount portion to form a loop. The mount hole enables passage of a fastener, such as bolts or screws, for fastening the mount portion to an anchoring structure, such as a wall. The second cable passageways enable passage of the terminus of the electric cable to form a loop that wraps around an anchoring structure, such as a post.

In one non-limiting embodiment, the cable passes through a second cable passageway to pass inside the mount cavity, and then through two adjacent second cable passageways to complete a loop outside the mount portion. Cutting the looped section of the cable disturbs the electrical continuity of the cable; and thereby triggers the alarm portion. In either mounting means, the mount portion of the apparatus is secured to the anchoring structure, such that the bag and/or item contained therein cannot be easily removed.

One objective of the present invention is to prevent tampering and theft of unattended packages delivered to a home or business.

Another objective is to provide a secure drop-off bag or pouch that can be opened and closed by both the package deliverer, and the package recipient.

Yet another objective is to enable the unattended package security apparatus to be firmly secured to a building door, wall, handrail, window grille or other fixed anchoring structure.

Yet another objective is to provide a security apparatus that does not require that the package recipient be home waiting for the delivery at the time the delivery is made.

Yet another objective is to provide an apparatus for the secure delivery of packages and other items to an unattended location which is simple, yet convenient and secure.

Yet another objective is to provide a secret code to the package recipient and the package deliverer for disengaging the alarms, so that the package can be retrieved or placed inside the bag.

Yet another objective is to trigger a loud buzzer and bright flashing lights if an attempt to cut the electric cable or the bag is made.

Yet another objective is to prevent axial movement of the electric cable with a releasable cable locking mechanism.

Yet another objective is to mount the alarm portion of the security apparatus with the loop formed by the cable, or with fasteners passing through the mounting holes in the mount portion.

Yet another objective is to cover the mesh sidewall with an opaque panel that shields the contents of the bag from viewers.

Yet another objective is to provide an inexpensive to manufacture electrical continuity unattended package security apparatus.

Other apparatus, devices, methods, features, and advantages will be or become apparent to one with skill in the art upon examination of the following drawings and detailed description. It is intended that all such additional apparatus, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 1A shows the apparatus empty, and FIG. 1B shows the apparatus securing a package, in accordance with an embodiment of the present invention;

FIG. 6A shows a frontal view, FIG. 6B shows a sectioned view, and FIG. 6C shows an interior view of the mount portion, in accordance with an embodiment of the present invention.

Like reference numerals refer to like parts throughout the various views of the drawings.

DETAILED DESCRIPTION OF THE INVENTION

Figure 1A:
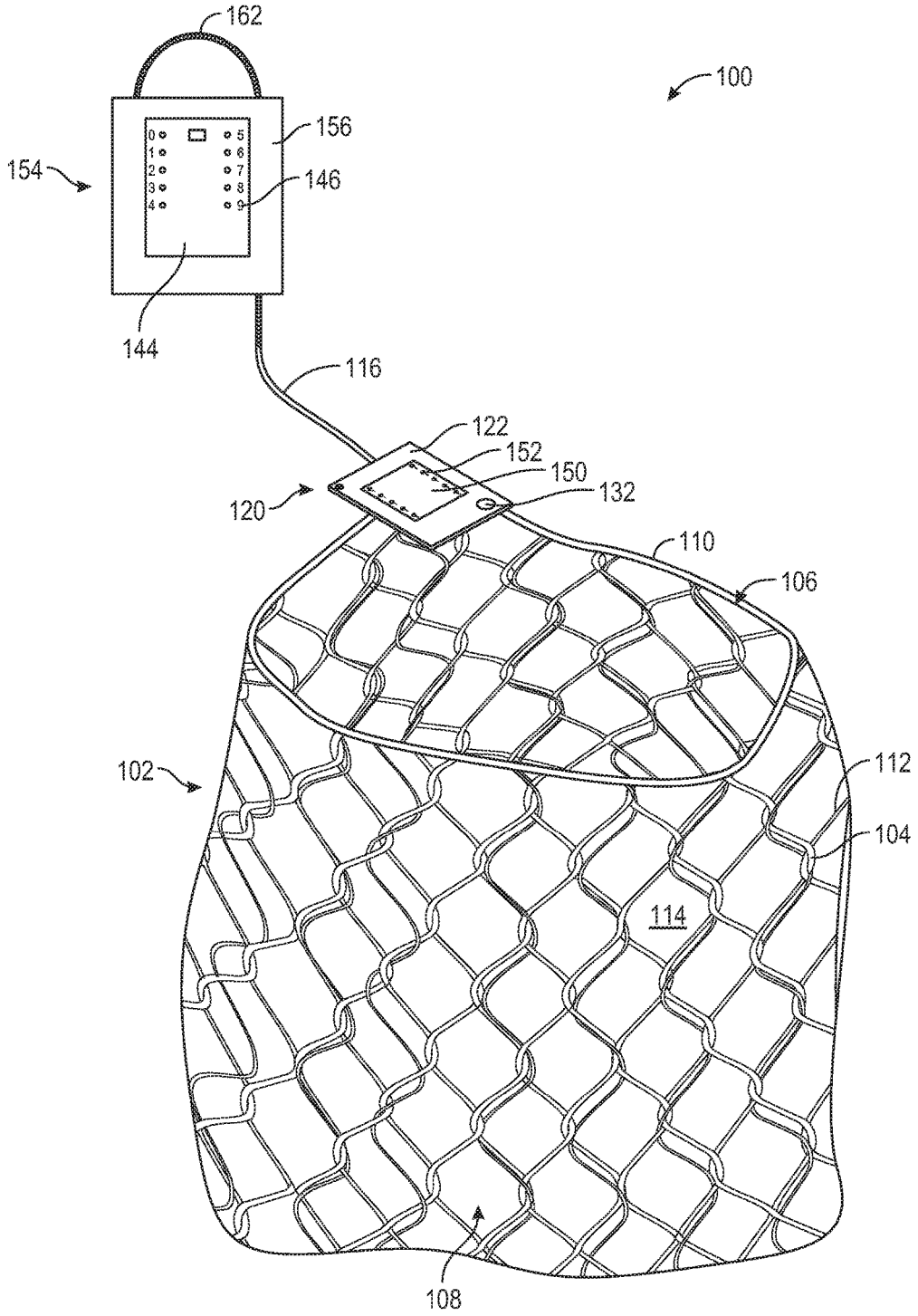
FIGS. 1A and 1B illustrate perspective views of an exemplary electrical continuity unattended package security apparatus, where

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1A. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

An electrical continuity unattended package security apparatus 100 and method 200 of operation is referenced in FIGS. 1A-7B. The electrical continuity unattended package security apparatus 100, hereafter "apparatus 100" is configured to prevent unattended delivered packages from being stolen, damaged, or tampered with. Assembly utilizes, a bag 102, which is defined by a mesh sidewall 104 and a matrix of conductive wires 112, to receive and store a delivered item 300 (package). An electric cable 116, carrying electrical current, is disposed around the perimeter 110 of opening 106 of bag 102. Electric cable 116 connects to the conductive wires 112, an illumination alarm 130, an audible alarm 132, a power source 164, a current sensing device 128, and other electrical components. Electric cable 116 also extends to an anchoring structure and forms a loop 162 at its terminus 118 to provide mounting means to anchoring structure. Fasteners also provide mounting means.

Apparatus 100 is unique in that any disruption to the electrical continuity of the electric cable 116 and conductive wires 112, i.e., cutting electric cable or conductive wires, manipulating cable, manipulating the perimeter of opening to bag, etc., is detected by the current sensing device 128, which transmits an interruption signal that triggers the illumination alarm 130 and the audible alarm 132. This creates an alert that notifies that an attempt at accessing the item 300 in the bag 102 has been made. An alarm coded pad 150 and a mount coded pad 144 enable access to the alarms 130, 132, reset switches, and electric cable 116 upon successful registry of a secret code from alphanumeric digits 152 registered into the alarm coded pad 150. A package deliverer and a package recipient have access to the code, so as to deactivate the alarms 130, 132 when depositing and collecting the item 300 in the bag 102.

Figure 1B:
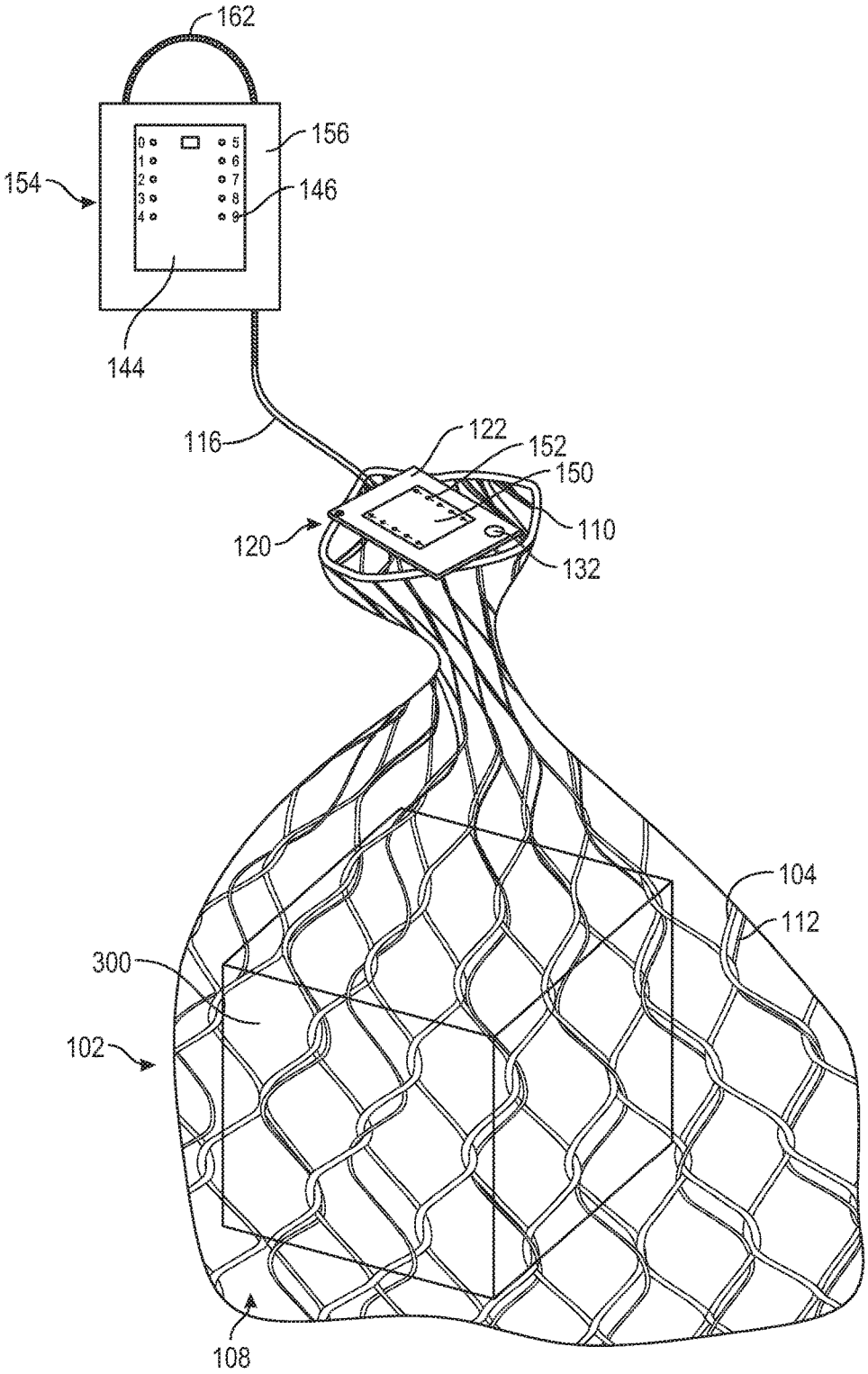

As referenced in FIG. 1B, apparatus 100 provides a bag 102, having generally conductive properties, and configured for receiving at least one item 300. Bag 102 may include a resilient bag, pouch, or other containment device known in the art for receiving packages. Bag 102 comprises a mesh sidewall 104 that allows for ventilation inside. Bag 102 forms an opening 106 to a cavity 108. The opening 106 is defined by a perimeter 110. The perimeter 110 may have an open hem or a channel for receiving one end of an electric cable 116, described below. Perimeter 110 is sufficiently durable, and may be reinforced to inhibit forcible attempts to pry open.

Bag 102 is generally resilient, and durable, so as not to be easily cut or ripped. Bag 102 sized and dimensioned to contain an item 300, such as a delivered package. However in other embodiments, item 300 may include, without limitation, a box, a letter, an electrical device, a pouch, a vessel containing liquids, a plant, an animal, and an irregular object.

In one non-limiting embodiment, a substantially opaque panel 114 at least partially covers the mesh sidewall 104 of the bag 102. The opaque panel 114 shields the cavity 108 of the bag—and thereby the item 300—from external viewing. This prevents unauthorized viewers from viewing the contents inside the cavity of bag 102. In one non-limiting embodiment, opaque panel is a synthetic fabric.

As shown in FIG. 1B, a matrix of conductive wires 112 extend across at least a portion of the mesh sidewall 104. Conductive wires 112 weave randomly, or follow a regular pattern across mesh sidewall 104. Each wire is connected to at least one other wire in the matrix. Conductive wires 112 are configured form electrical continuity as long as electrical current is running through electric cable 116. Cutting, bending, shorting, or pulling on wires 112 may interrupt the electrical continuity. Similarly, cutting, bending, or pulling the mesh sidewall 104 also interrupts the electrical continuity.

As illustrated in FIG. 1B, apparatus 100 further comprises an electric cable 116 disposed around the perimeter 110 of the opening 106 of bag. Electric cable 116 is operable to cinch the perimeter 110 of the bag 102 from one end, and extend out to an anchoring structure from a terminus 118. Thus, disturbing the perimeter 110 of the bag 102 also disturbs the electric cable 116. Further, electric cable 116 carries an electrical current. In one non-limiting embodiment, electrical cable 116 comprises a sheath containing two wires.

Electric cable 116 is in contact with at least one of the conductive wires 112 that run across the mesh sidewall 104 of bag 102. Thus, electrical current runs through both the electric cable 116 and the conductive wires 112 from the same power source 164. In this manner, the electrical current creates electrical continuity through the electric cable 116 and the conductive wires 112.

Figure 2:
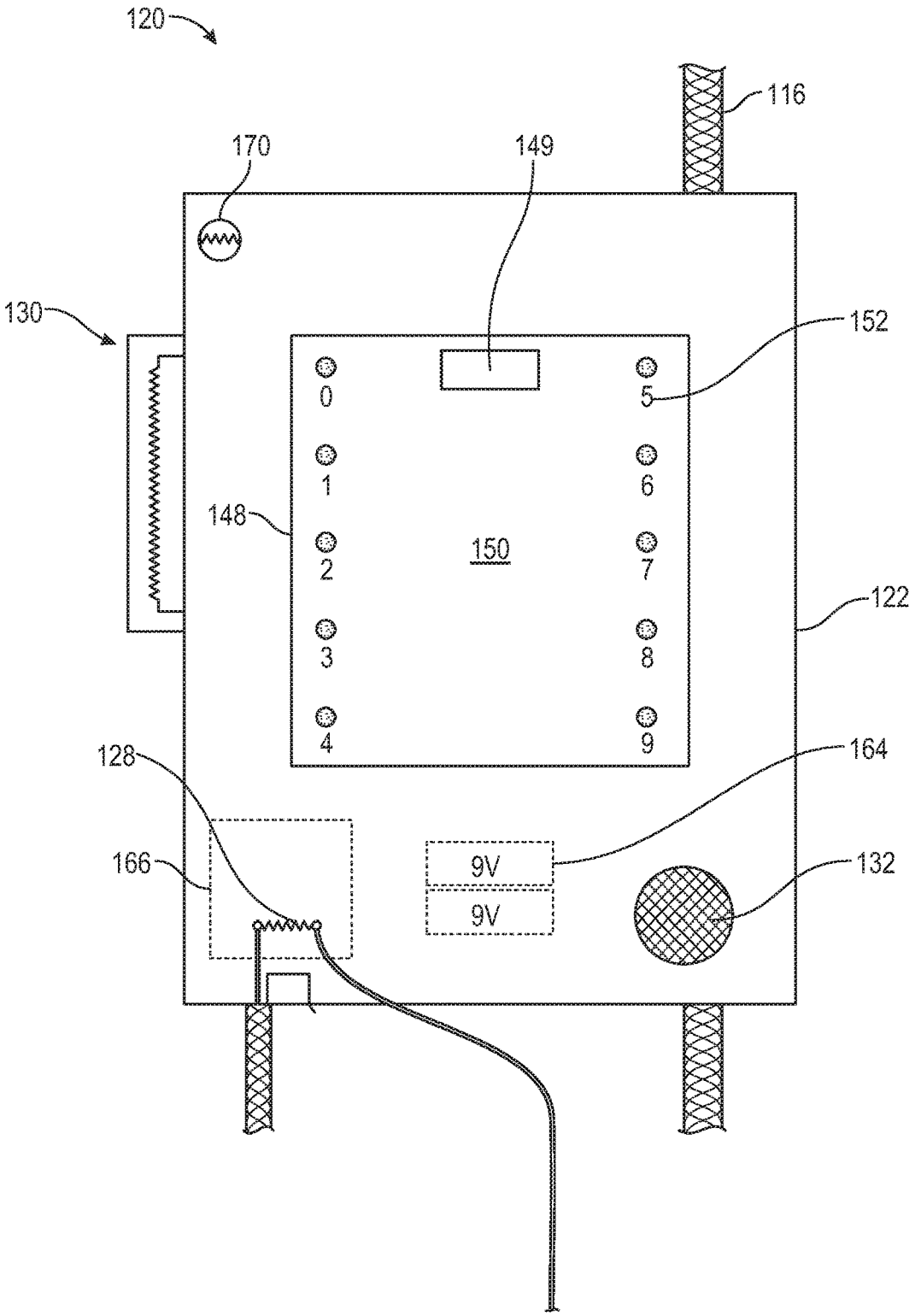
FIG. 2 illustrates a frontal view of an exemplary alarm portion, in accordance with an embodiment of the present invention.

Turning now to FIG. 2, apparatus 100 provides an alarm portion 120 that is configured to detect when electrical continuity in electric cable 116 and/or the conductive wires 112 is interrupted, and responsively trigger an alarm 130, 132. Alarm portion 120 further serves to provide electrical power to the electric cable 116. Alarm portion 120 further works to restrict the axial movement of the electric cable 116, so that cable 116 is not disconnected from the bag 102. Alarm portion 120 positions adjacent to the perimeter 110 of the bag 102. Though in some embodiments, alarm portion 120 may be attached to bag 102.

In one non-limiting embodiment, alarm portion 120 comprises an alarm sidewall 122 that protects components contained in an alarm cavity 124. In one embodiment, alarm portion 120 has a generally rectangular shape. Alarm portion 120 is defined by a pair of first cable passageway 126*a*, 126*b*. First cable passageway 126*a-b* are oppositely disposed on alarm sidewall 122, so as to enable passage of electric cable 116 through alarm sidewall 122. In this manner, electric cable 116 carries the electrical current between alarm portion 120 and bag 102.

In one non-limiting embodiment, alarm portion 120 includes a current sensing device 128 that is operationally connected to the electric cable 116. Current sensing device 128 is operable to detect electrical continuity through the electric cable 116 and the conductive wires 112. Current sensing device 128 is also operable to transmit an interruption signal if the electrical continuity is disturbed. This is an indication that tampering, i.e. cutting, pulling, shorting, of the electric cable 116 or conductive wires 112 is occurring.

Those skilled in the art will recognize that theft of the item 300 in the bag 102 would require such tampering to achieve opening 106 or cutting the bag 102; or cutting the electric cable 116 from the anchoring structure. In one non-limiting embodiment, current sensing device 128 includes at least one of the following: a voltage indicator, a cable 116 tester, a connector board, and a low voltage tester.

Figure 3:
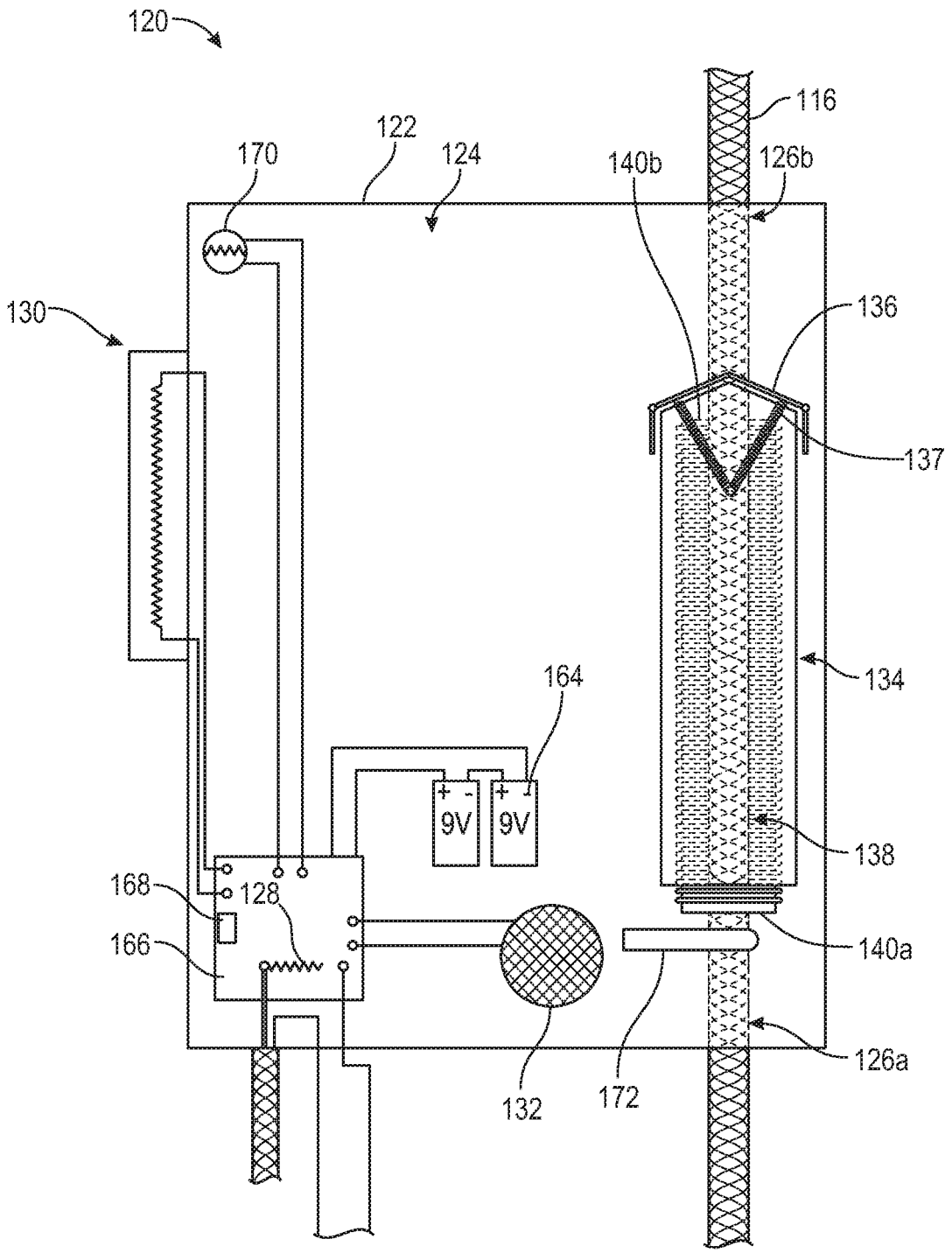
FIG. 3 illustrates a sectioned view of the alarm portion shown in FIG. 2, highlighting the electrical components, in accordance with an embodiment of the present invention.

Turning now to FIG. 3, alarm cavity 124 contains an illumination alarm 130 being operatively connected to the current sensing device 128. Illumination alarm 130 is operable to illuminate when detecting the interruption signal from the current sensing device 128. In one non-limiting embodiment, illumination alarm 130 is operable to illuminate in a flashing lighting pattern. In another embodiment, illumination alarm 130 is a flashing bright light.

In one non-limiting embodiment, alarm portion 120 contains an audible alarm 132 being operatively connected to the current sensing device 128. Audible alarm 132 is operable to emit an audio signal when detecting the interruption signal from the current sensing device 128. In one non-limiting embodiment, audible alarm 132 is a siren-like buzzer operating at 110 DB.

Figure 4:
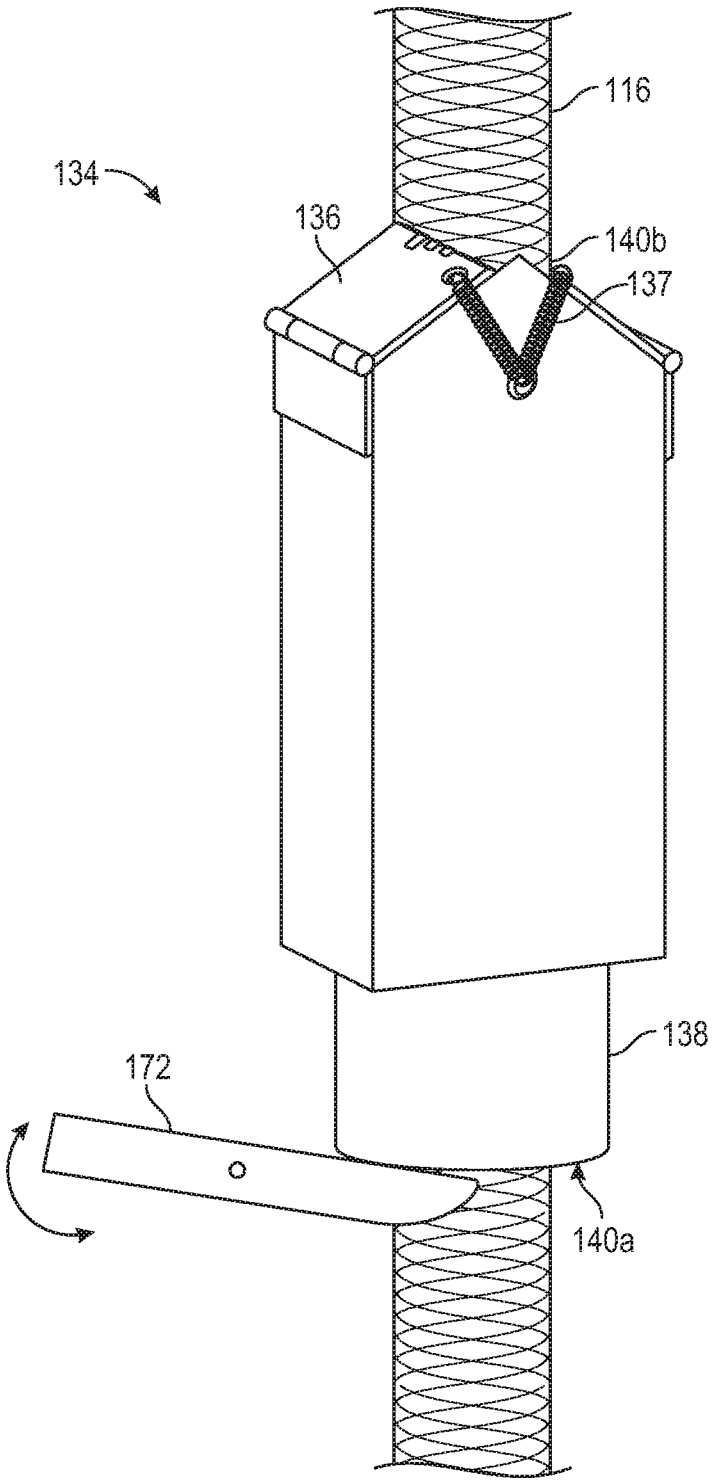
FIG. 4 illustrates a perspective view of an exemplary releasable cable locking mechanism, in accordance with an embodiment of the present invention.

Turning now to FIG. 4, alarm cavity 124 further contains a releasable cable locking mechanism 134 that helps prevent axial movement by electric cable 116. Those skilled in the art will recognize that axial movement would be required to pull bag 102 from anchoring structure, or to forcibly separate bag 102 from electrical cable 116.

In one non-limiting embodiment, releasable cable locking mechanism 134 comprises a spring-loaded clamp 136 that is operable to forcibly clamp the electric cable 116, and thereby restrict axial movement by electric cable 116. Releasable cable locking mechanism 134 provides a cable throughway 138 which allows electric cable 116 to concentrically pass through alarm portion 120 through use of two opposite openings 140*a*, 140*b*.

Figure 5:
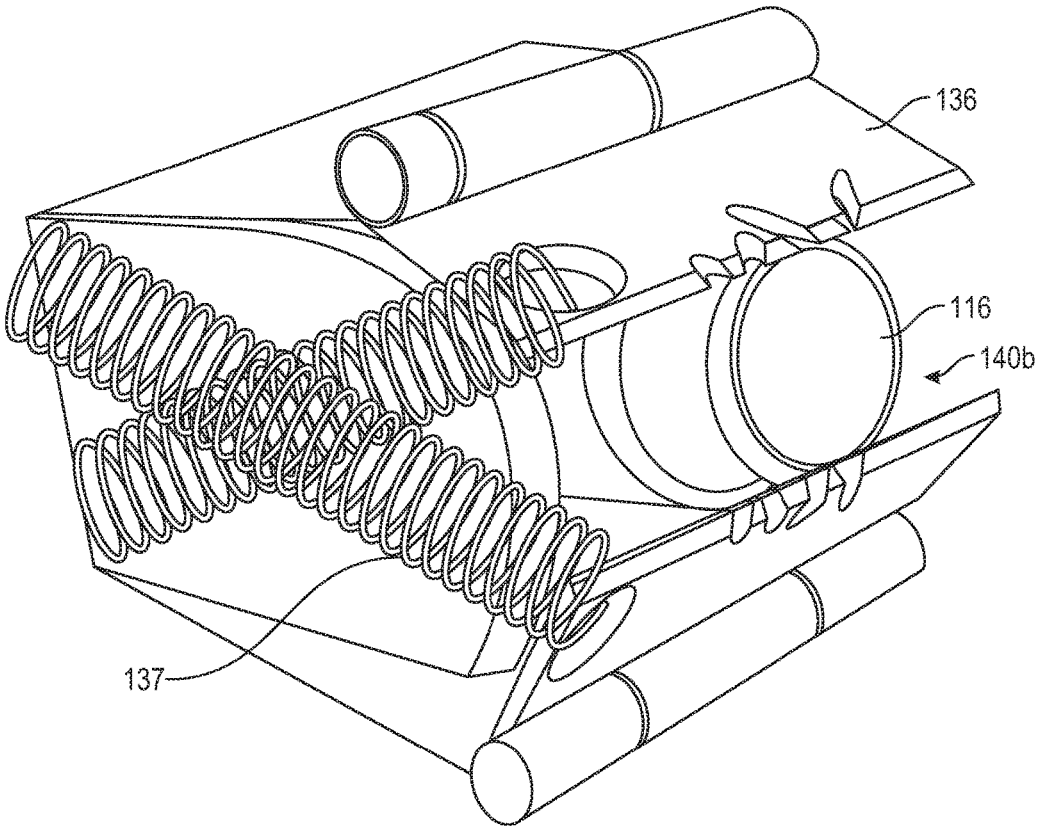
FIG. 5 illustrates a close up view of an exemplary spring-loaded clamp retaining a cable in the releasable cable locking mechanism, in accordance with an embodiment of the present invention.

As shown in FIG. 5, spring-loaded clamp 136 is operable to clamp down on electric cable 116 from outside the cable throughway 138. In yet other embodiments, a cable release mechanism 172 operatively connects to spring-loaded clamp 136 of releasable cable locking mechanism 134. Cable release mechanism 172 is operable to release the electric cable 116 from the spring-loaded clamp 136. In one embodiment, cable release mechanism 172 is a lever that pries open a spring 137 that biases the spring-loaded clamp 136 to clamp.

Alarm portion 120 further includes an alarm gate 148 that regulates access to alarm cavity in alarm portion 120. An opening latch 149 on alarm portion 120 enables access to inside of the box. In one non-limiting embodiment, alarm code pad door is a door that hingedly opens and closes. Though in other embodiments, alarm gate 148 may slidably open and close; or snap on and off the alarm sidewall 122.

Since alarm cavity 124 contains a section of electric cable 116, illuminating alarm, audible alarm 132, and other electrical components; alarm gate 148 is useful for activating and deactivating alarms when the package recipient and the package deliverer are collecting or positioning item 300 in bag 102. In essence, alarm gate 148 protects sensitive contents from tampering, and also allows alarms to be deactivated during delivery and collection of item 300 into bag 102.

In one non-limiting embodiment, apparatus 100 utilizes an alarm coded pad 150 to control the alarm gate 148. Alarm coded pad 150 is similar to a key, except that a code is used to open or lock the alarm gate 148. In one non-limiting embodiment, alarm coded pad 150 comprises a plurality of alphanumeric digits 152 that define a code for opening or locking alarm gate 148; and thereby accessing alarm cavity. When the package recipient or the package deliverer register a predetermined code into the alarm coded pad 150, the alarm gate 148 opens or locks, so as to enable access to alarm cavity 124.

For example, the package recipient presets a code into the alarm coded pad 150. The package deliverer is notified of the code. After the package deliverer arrives at the delivery site, knowing the assigned code, the package deliverer can deactivate the alarms to place the item 300 in the bag 102. In this manner, numerous package deliveries can be arranged for a given day, which is made more secure since the bag 102 can be opened even if excess codes are entered, or the code are entered in a different order, so that nominally different codes can be assigned.

However in other embodiments, no alarm coded pad 150 is used to open or lock the alarm gate 148. A package delivery person does not need to enter a code to open or lock the alarm gate 148 when delivering a package. The perimeter of bag opening is already open ready for package to be put inside of bag. All the delivery person needs to do is pull cable to cinch opening closed. It is not necessary to enter a code to activate alarm system, alarm system is activated by on/off switch on circuit board. In other words alarm system is active before, during, and after delivery of package and only needs to be turned off when not in use, or when cable wires have been cut or tampered with to stop alarms.

Figure 6A:
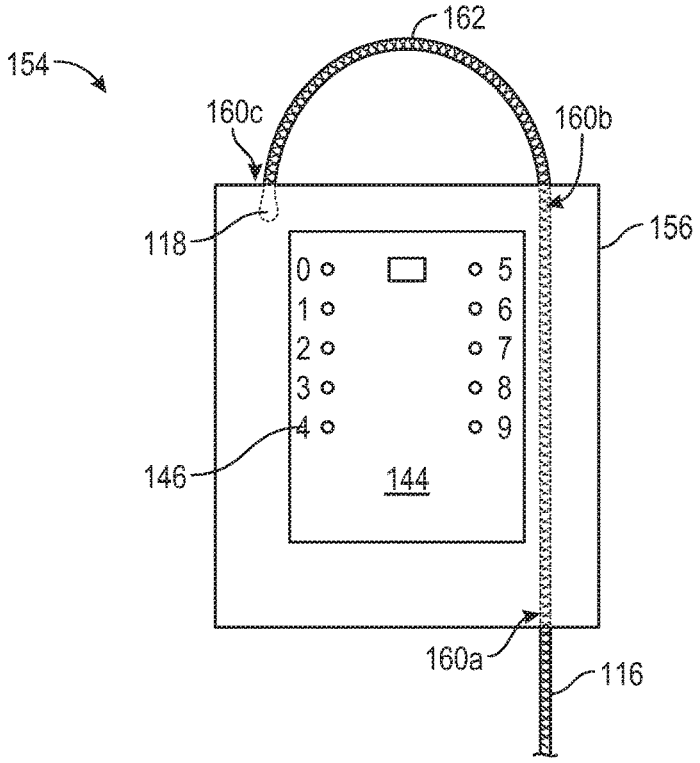
FIGS. 6A, 6B, and 6C illustrate views of an exemplary mount portion with a cable looped for mounting, where

Turning now to FIG. 6A, apparatus 100 provides a mount portion 154 that provides the mounting means for apparatus 100. Mount portion 154 is approximately where electric cable 116 terminates, forming a loop 162 that wraps around an anchoring structure, such as a post. Mount portion 154 also directly mounts to a more planar anchoring structure, such as a wall or door. In one non-limiting embodiment, mount portion 154 comprises a mount sidewall 156 that is defined by a mount cavity 158.

Mount sidewall 156 also forms a plurality of second cable passageways 160*a-c*, and at least one mounting hole 174*a*, 174*b*. As in alarm portion 120, electric cable 116 carries the electrical current between the mount portion 154 and the bag 102. Thus, second cable passageways 160*a-c* are useful for enabling electric cable 116 to pass through mount sidewall 156 and form a loop 162 to wrap around anchoring structure.

Figure 6B:
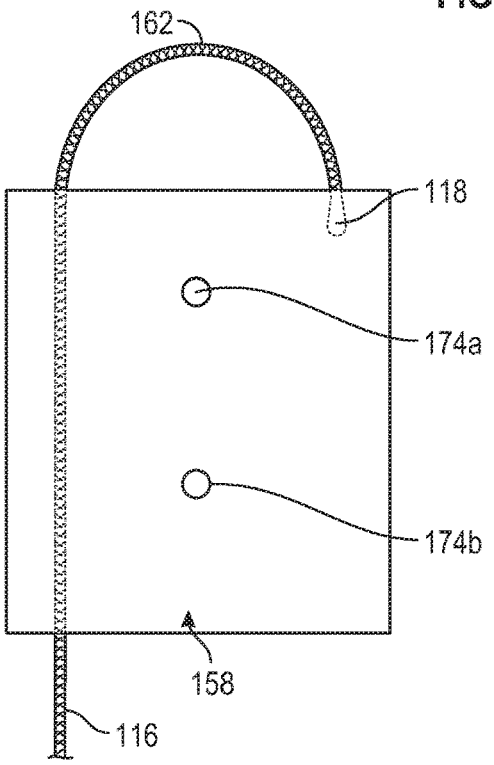

As referenced in FIG. 6B, at least one mounting hole forms on one surface of mount sidewalls 156. Thus, mounting hole enabling passage of a fastener through mount sidewall 156. Fastener helps fasten the mount portion 154 to an anchoring structure, such as a wall or door panel. Fastener may include, without limitation, a screw, a bolt, a hook, and an adhesive. In this manner, apparatus 100 is not easily removed from anchoring structure; thereby protecting from removal of item 300 in bag 102. Cavity 158 in FIG. 6B forms in the back wall of cavity.

Figure 6C:
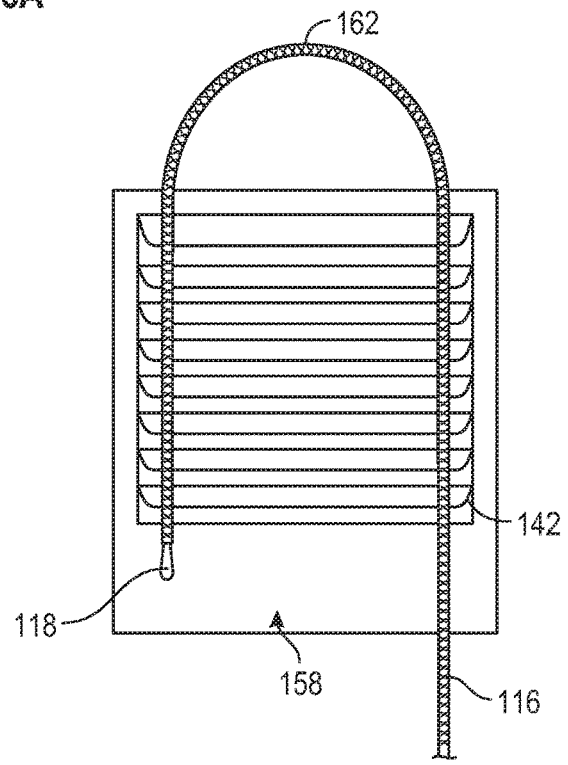

As FIG. 6C illustrates, mount portion 154 may further include a mount gate 142 that regulates access to the mount cavity 158. This allows for maintenance and interchanging of parts. In one non-limiting embodiment, mount gate 142 is a door that hingedly opens and closes. Though in other embodiments, mount gate 142 may slidably open and close, or snap on and off the mount sidewall 156. In one embodiment, the mount gate includes louvers to keep cable pinched between opening door and back of mount code box so as not to be able to remove cable unless mount code pad door is open thus allowing cable loop to be adjusted to various sizes or length.

Similar to alarm coded pad 150 described above, mount portion 154 provides a mount coded pad 144 that controls the mount gate 142. In one non-limiting embodiment, mount coded pad 144 comprises a plurality of alphanumeric digits 146 that provides a code for accessing mount cavity 158. Thus, when a predetermined code is registered, the mount gate 142 opens to enable access to mount cavity 158. However, package deliverer generally does not need to open mount portion 154, since the alarm components are located in alarm portion 120 of apparatus 100. Package recipient may access mount cavity 158 to affix looped 162 end of electric cable 116 to anchoring structure, such as a pole.

Looking again at FIG. 3, alarm cavity 124 contains a power source 164 that provides electricity to components, such as the electric cable 116, illumination alarm 130, and audible alarm 132. In one non-limiting embodiment, power source 164 may include two 9 volt batteries. In another embodiment, alarm cavity 124 contains a circuit board 166 configured to regulate operation of various components, including the current sensing device 128, the illumination alarm 130, and the audible alarm 132. Circuit board 166 may include a printed circuit board 166 mechanically that supports and electrically connects electronic components or electrical components using conductive tracks, pads, and other features etched from one or more silicon wafer sheets.

In yet another embodiment, alarm cavity 124 contains a power switch 168 that is operational to power on and off the illumination alarm 130 and the audible alarm 132. In yet another embodiment, alarm cavity 124 contains a power indicating light 170, such as a red LED bulb that indicates the status of the power source 164, i.e. battery is low. Power switch 168, power source 164, and circuit board 166 are accessed by opening the alarm gate 148.

Figure 7A:
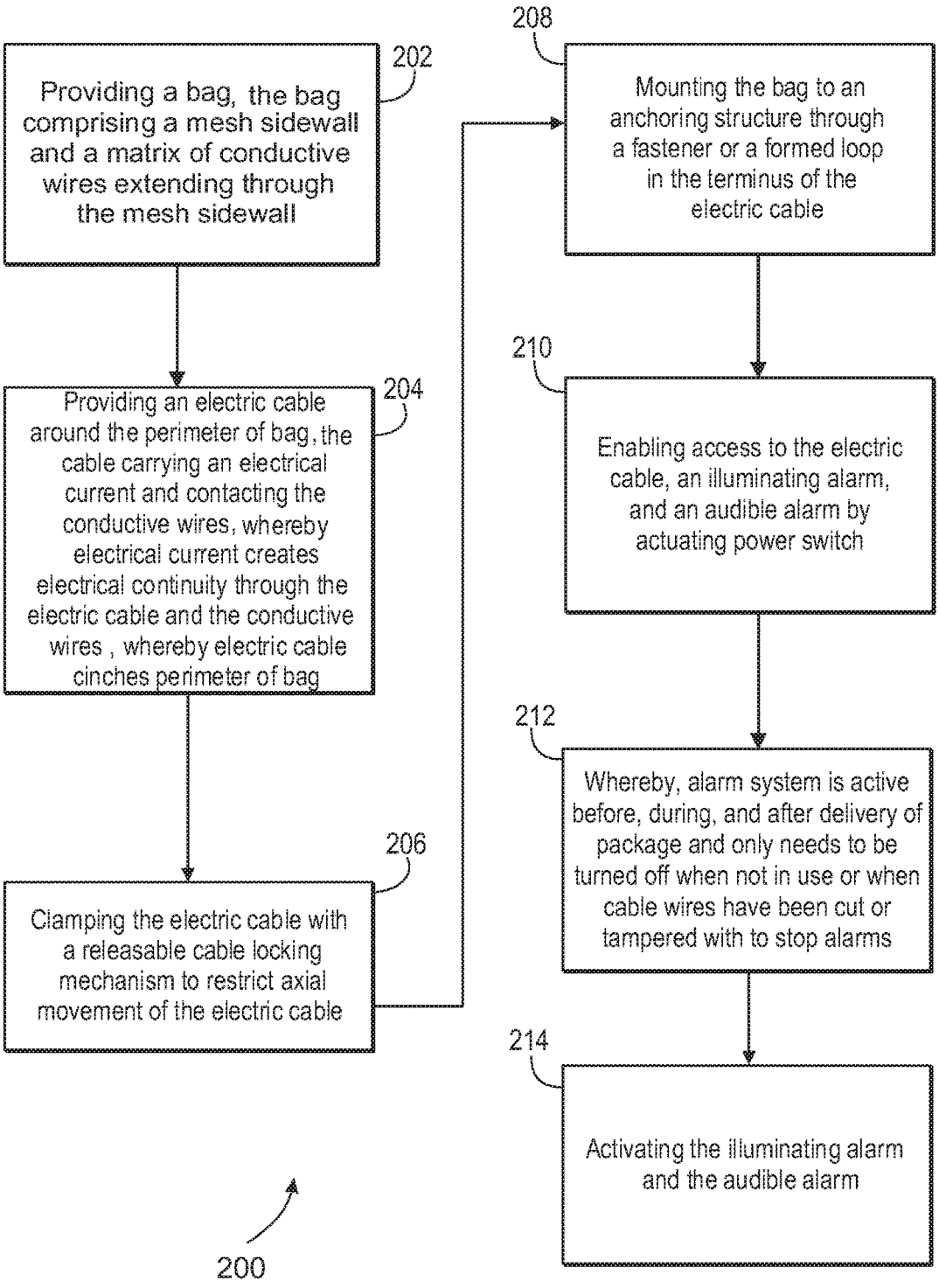
FIGS. 7A and 7B reference a flowchart for a method for operation of an electrical continuity unattended package security apparatus, in accordance with an embodiment of the present invention.
Figure 7B:
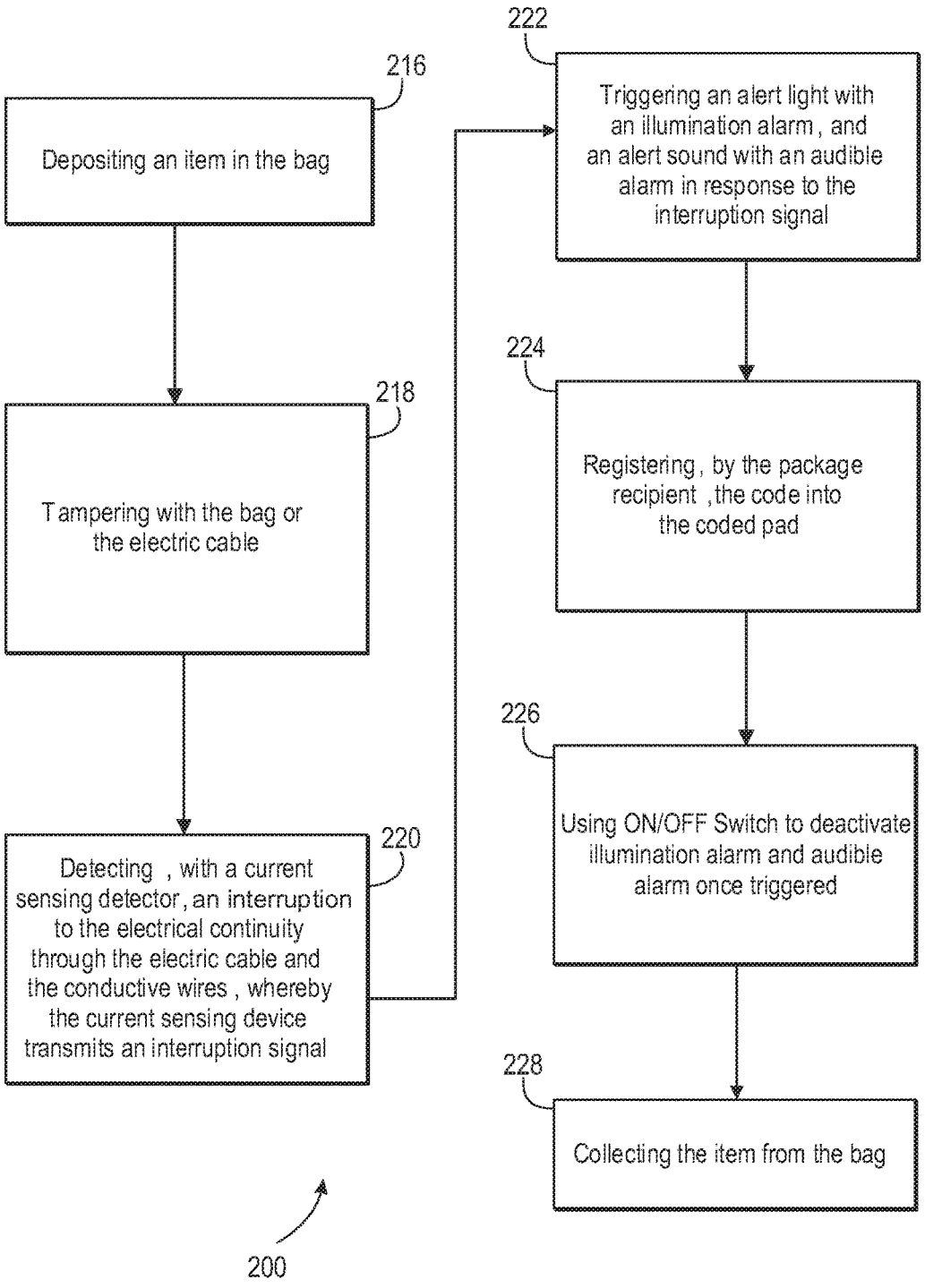

FIGS. 7A and 7B reference a flowchart for an exemplary method 200 for operation of an electrical continuity unattended package security apparatus. In one non-limiting embodiment, method 200 comprises an initial Step 202 of providing a bag, the bag comprising a mesh sidewall and a matrix of conductive wires extending through the mesh sidewall.

A Step 204 includes providing an electric cable disposed around the perimeter of the bag, the electric cable carrying an electrical current, the electric cable contacting at least one of the conductive wires, whereby the electrical current creates electrical continuity through the electric cable and the conductive wires, whereby the electric cable is operable to cinch the perimeter of the bag. Method 200 may further comprise a Step 206 of clamping the electric cable with a releasable cable locking mechanism to restrict axial movement of the electric cable. A Step 208 includes mounting the bag to an anchoring structure through a fastener or a formed loop in the terminus of the electric cable.

In some embodiments, a Step 210 comprises enabling access to the electric cable, an illuminating alarm, and an audible alarm by actuating power switch. Step 212 includes whereby, alarm system is active before, during, and after delivery of package and only needs to be turned off when not in use or when cable wires have been cut or tampered with to stop alarms. In some embodiments, a Step 214 may include activating the illuminating alarm and the audible alarm. A Step 216 comprises depositing an item in the bag.

Method 200 may further comprise a Step 218 of tampering with the bag or the electric cable. A Step 220 includes detecting, with a current sensing detector, an interruption to the electrical continuity through the electric cable and the conductive wires, whereby the current sensing device transmits an interruption signal. In some embodiments, a Step 222 comprises triggering an alert light with an illumination alarm, and an alert sound with an audible alarm in response to the interruption signal. A Step 224 includes registering, by the package recipient, the code into the coded pad. In some embodiments, a Step 226 may include using on/off switch to deactivate illumination alarm and audible alarm once triggered. A final Step 228 comprises collecting the item from the bag.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. An electrical continuity unattended package security apparatus, the apparatus comprising:

a bag comprising a mesh sidewall, the mesh sidewall forming an opening to a cavity, the opening being defined by a perimeter;

a matrix of conductive wires extending across at least a portion of the mesh sidewall;

a substantially opaque panel at least partially covering the mesh sidewall of the bag;

an electric cable disposed around the perimeter of the opening, the electric cable carrying an electrical current, the electric cable contacting at least one of the conductive wires, whereby the electrical current creates electrical continuity through the electric cable and the conductive wires, an alarm portion comprising:

an alarm sidewall being defined by an alarm cavity and a pair of first cable passageways, the first cable passageways enabling passage of the electric cable through the alarm sidewall, whereby the electric cable carries the electrical current between the alarm portion and the bag, a current sensing device operationally connected to the electric cable, the current sensing device being operable to detect electrical continuity through the electric cable and the conductive wires, the current sensing device further being operable to transmit an interruption signal if the electrical continuity is disturbed;

an illumination alarm being operatively connected to the current sensing device, the illumination alarm being operable to illuminate when detecting the interruption signal from the current sensing device;

an audible alarm being operatively connected to the current sensing device, the audible alarm being operable to emit an audio signal when detecting the interruption signal from the current sensing device;

a releasable cable locking mechanism disposed in the alarm cavity, the releasable cable locking mechanism comprising a spring-loaded clamp operable to clamp the electric cable, whereby the spring-loaded clamp restricts axial movement by the electric cable;

an alarm gate regulating access to the alarm cavity;

an alarm coded pad controlling the alarm gate;

a mount portion comprising:

a mount sidewall being defined by a mount cavity, a plurality of second cable passageways, and at least one mounting hole, the plurality of second cable passageways enabling passage of the electric cable through the mount sidewall to form a loop, whereby the electric cable carries the electrical current between the mount portion and the bag;

a mount gate regulating access to the mount cavity; and a mount coded pad controlling the mount gate.

2. The apparatus of claim 1, wherein the electric cable is operable to cinch the perimeter of the bag.

3. The apparatus of claim 1, wherein the bag is sized and dimensioned to contain an item.

4. The apparatus of claim 1, wherein the current sensing device includes at least one of the following: a voltage indicator, a cable tester, a connector board, and a low voltage tester.

5. The apparatus of claim 1, wherein the releasable cable locking mechanism comprises a cable throughway defined by two openings.

6. The apparatus of claim 5, wherein the electric cable passes through the cable throughway.

7. The apparatus of claim 1, further comprising a cable release mechanism operatively connected to the spring-loaded clamp of the releasable cable locking mechanism.

8. The apparatus of claim 7, wherein the cable release mechanism is operable to release the electric cable from the spring-loaded clamp.

9. The apparatus of claim 1, wherein the alarm gate hingedly opens and closes.

10. The apparatus of claim 1, wherein the alarm coded pad comprises a plurality of alphanumeric digits, whereby when a predetermined code is registered the alarm gate opens to enable access to the alarm cavity.

11. The apparatus of claim 1, wherein the mount gate hingedly opens and closes with an opening latch.

12. The apparatus of claim 1, wherein the mount coded pad comprises a plurality of alphanumeric digits, whereby when a predetermined code is registered the mount gate opens to enable access to the mount cavity.

13. The apparatus of claim 1, wherein the mounting hole enables passage of a fastener, whereby the fastener helps fasten the mount portion to an anchoring structure.

14. The apparatus of claim 13, wherein the fastener comprises a screw or a bolt.

15. The apparatus of claim 1, wherein the illumination alarm is operable to illuminate in a flashing lighting pattern.

16. The apparatus of claim 1, further comprising a power source providing electricity to at least one of the following: the electric cable, the illumination alarm, and the audible alarm.

17. The apparatus of claim 1, further comprising a circuit board regulating at least one of the following: the current sensing device, the illumination alarm, and the audible alarm.

18. The apparatus of claim 1, further comprising a power switch operational to power on and off the illumination alarm and the audible alarm.

19. An electrical continuity unattended package security apparatus, the apparatus consisting of:

a bag comprising a mesh sidewall, the mesh sidewall forming an opening to a cavity, the opening being defined by a perimeter;

a matrix of conductive wires extending across at least a portion of the mesh sidewall;

a substantially opaque panel at least partially covering the mesh sidewall of the bag;

an electric cable disposed around the perimeter of the opening, the electric cable carrying an electrical current, the electric cable contacting at least one of the conductive wires, whereby the electrical current creates electrical continuity through the electric cable and the conductive wires, whereby the electric cable is operable to cinch the perimeter of the bag;

an alarm portion comprising:

an alarm sidewall being defined by an alarm cavity and a pair of first cable passageways, the first cable passageways enabling passage of the electric cable through the alarm sidewall, whereby the electric cable carries the electrical current between the alarm portion and the bag, a current sensing device operationally connected to the electric cable, the current sensing device being operable to detect electrical continuity through the electric cable and the conductive wires, the current sensing device further being operable to transmit an interruption signal if the electrical continuity is disturbed;

an illumination alarm being operatively connected to the current sensing device, the illumination alarm being operable to illuminate when detecting the interruption signal from the current sensing device;

an audible alarm being operatively connected to the current sensing device, the audible alarm being operable to emit an audio signal when detecting the interruption signal from the current sensing device;

a releasable cable locking mechanism disposed in the alarm cavity, the releasable cable locking mechanism comprising a spring-loaded clamp operable to clamp the electric cable, whereby the spring-loaded clamp restricts axial movement by the electric cable, the releasable cable locking mechanism further comprising a cable throughway defined by two openings;

a cable release mechanism operatively connected to the spring-loaded clamp of the releasable cable locking mechanism, the cable release mechanism being operable to release the electric cable from the spring-loaded clamp;

an alarm gate regulating access to the alarm cavity;

an alarm coded pad controlling the alarm gate;

a mount portion comprising:

a mount sidewall being defined by a mount cavity, a plurality of second cable passageways, and at least one mounting hole, the plurality of second cable passageways enabling passage of the electric cable through the mount sidewall to form a loop, whereby the electric cable carries the electrical current between the mount portion and the bag, the mounting hole enabling passage of a fastener, whereby the fastener helps fasten the mount portion to an anchoring structure;

a mount gate regulating access to the mount cavity;

a mount coded pad controlling the mount gate;

a power source providing electricity to at least one of the following: the electric cable, the illumination alarm, and the audible alarm;

power indicating light indicating status of the power source;

a circuit board regulating at least one of the following: the current sensing device, the illumination alarm, and the audible alarm; and a power switch operational to power on and off the illumination alarm and the audible alarm.

20. A method for operation of an electrical continuity unattended package security apparatus, the method comprising:

providing a bag, the bag comprising a mesh sidewall, and a matrix of conductive wires extending through the mesh sidewall;

providing an electric cable disposed around a perimeter of the bag, the electric cable carrying an electrical current, the electric cable contacting at least one of the conductive wires, whereby the electrical current creates electrical continuity through the electric cable and the conductive wires, whereby the electric cable is operable to cinch the perimeter of the bag;

clamping the electric cable with a releasable cable locking mechanism to restrict axial movement of the electric cable;

mounting the bag to an anchoring structure through a fastener or a formed loop in a terminus of the electric cable;

enabling access to the electric cable, an illuminating alarm, and an audible alarm by actuating power switch;

whereby an alarm system is active before, during, and after delivery of package and only needs to be turned off when not in use or when cable wires have been cut or tampered with to stop alarms;

activating the illuminating alarm and the audible alarm;

depositing an item in the bag;

tampering with the bag or the electric cable;

detecting, with a current sensing detector, an interruption to the electrical continuity through the electric cable and the conductive wires, whereby the current sensing device transmits an interruption signal;

triggering an alert light with an illumination alarm, and an alert sound with an audible alarm in response to the interruption signal;

registering, by a package recipient, a predetermined code into a coded pad controls a gate; and using a power switch to deactivate illumination alarm and audible alarm once triggered; and collecting the item from the bag.

* * * * *